US005727675A

United States Patent [19]

Leveque et al.

[11] Patent Number: 5,727,675

[45] Date of Patent: Mar. 17, 1998

[54] LATCHING PUSHBUTTON SWITCH ASSEMBLY

[75] Inventors: Denis J. Leveque; Michael R. Larsen, both of Milwaukee, Wis.

[73] Assignee: Eaton Corporation, Cleveland, Ohio

[21] Appl. No.: 706,543

[22] Filed: Sep. 6, 1996

[51] Int. Cl.[6] ..... H01H 3/42

[52] U.S. Cl. ..... 200/524; 200/530; 200/531; 200/314

[58] Field of Search ..... 200/531, 532, 200/536, 524, 523, 520, 252, 253.1, 284, 314

[56] References Cited

U.S. PATENT DOCUMENTS

| | | | |
|---|---|---|---|
| 4,001,526 | 1/1977 | Olson | 200/531 |
| 4,549,050 | 10/1985 | Lang | 200/314 |
| 4,733,028 | 3/1988 | Flumignan | 200/531 |
| 5,221,816 | 6/1993 | Williams | 200/531 |
| 5,463,198 | 10/1995 | Shimaoka | 200/531 |
| 5,528,007 | 6/1996 | Williams et al. | 200/531 |

*Primary Examiner*—David J. Walczak

*Attorney, Agent, or Firm*—Roger A. Johnston

[57] ABSTRACT

A push-push latching switch assembly having a switching member with a pushbutton which is received for sliding movement in a switch housing. The housing has spring tabs for snap locking insertion into a hole in a mounting panel. The switching member has lamps disposed in a receptacle portion beneath the button which has translucent lens portions for illumination by the lamps. The switching member has conductive strips formed by plating over two-shot integrally molded plastic strips, with the conductive strips interconnecting the lamps and wiper contacts attached to the switching member. A conductive wiper member with plural wiper fingers is also attached to the switching member. A base member formed of two-shot molded plastic has conductive switching contact strips formed by plating the second shot molded plastic and which are inserted in the housing, with the base releasably attached. User pressure on the button causes the switching member to move relative to the housing sliding the wipers on the strips for switching and continuously providing power to the lamps. The conductive plated strips extend externally to form connector pins. A cardiod cam and latch provide the push to latch, push to unlatch function.

13 Claims, 6 Drawing Sheets

LATCHING PUSHBUTTON SWITCH ASSEMBLY

BACKGROUND OF THE INVENTION

The present invention relates to push-push electrical switches of the type intended for mounting on a panel or housing and having an illuminated pushbutton to facilitate user actuation in low light conditions. The switch is of the type adapted to be connected to a wiring harness by a plug-in socket connector and is of the type conveniently employed in motor vehicle applications operating at relatively low voltages for vehicle accessory controls. Latching push-push switches are typically employed for actuation of certain motor vehicle accessories where it is desired to provide illumination to the pushbutton for relative ease of user location in low light conditions and to provide separate illuminated indicia of the state of actuation of the switch.

Heretofore, such switches have required several discrete switching circuits and circuits for power to the source of illumination which has resulted in multiple connector pins, terminal strips and contacts within the switch. Typically, these parts are formed of separate or discrete pieces of electrical conductive material mechanically assembled into the switch or separately insert molded into the parts of the switch housing or base as they are fabricated. This type of design and assembly has proven to be relatively costly and difficult to assemble in manufacture. It has thus been desired to provide a way or means of simplifying and reducing the manufacturing costs of a latching pushbutton switch which has an illuminated button and provides for separately illuminated indicia of the state of actuation of the switch.

SUMMARY OF THE INVENTION

It is an object of the present invention to provide an improved low-cost push-to-actuate push-to-deactuate latching switch assembly having the pushbutton illuminated and having separate illuminated indicia for indicating the state of actuation and to provide for panel mounting of the switch assembly and connection to a multiple socket connector.

It is a further object of the present invention to provide a push-push latching switch assembly having the stationary electrical contacts and interconnecting conductors between the contacts and the external connecting terminals formed of platable plastic material which is subsequently plated to provide for electrical conductivity.

The present invention has a switch housing adapted for connection to a panel with a switching member slidably received therein in a receptacle provided in the switching member with sockets for the sources of illumination provided on the opposite end of the switching member to which is attached a user actuating pushbutton with a lens thereon. The base of the switch has molded plastic strips thereon which are subsequently electroplated to provide the stationary electrical contacts and which strips extend externally for providing connector terminal pins.

The switching member includes a separate wiper member having a plurality of wiper fingers for making sliding contact with the plated conductors on the base member. One set of wipers engages an external surface of the base member for a switching function; and, a second set of conductive wipers engages other plated conductive strips provided in internal recesses in the base member. A separate latching member engages the switching member to hold it in the actuated condition; and, the latching mechanism is released by the user again pushing on the switching member actuator button. The switch of the present invention thus is assembled by engaging the switching member and base from opposite ends of the housing to provide a completed switch assembly.

DETAILED DESCRIPTION

Figure 2:
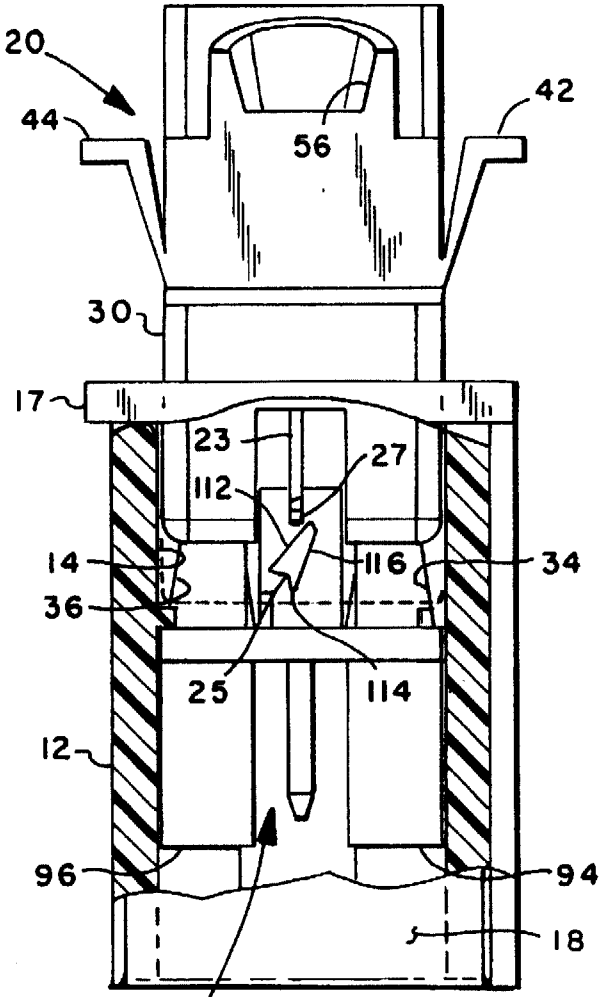
FIG. 2 is a view taken along section indicating lines 2—2 of FIG 1 with portions broken away.

Referring to FIGS. 1 through 6, the switch assembly of the present invention is indicated generally at 10 and includes a housing 12 having preferably a rectangular configuration and having a hollow centrally therethrough as indicated by reference numeral 14. and a mounting flange 17 formed thereon. Housing 12 has disposed on opposite sides thereof a pair of resiliently deflectable mounting tabs 16, 18 which are adapted to engage the under surface of a panel or mounting structure 19 into which the housing is inserted with the undersurface of housing flange 17 registering on the surface of the panel 19.

Housing 12 has received in the upper end of hollow 14 a switching member subassembly indicated generally at 20; and, in the lower or opposite end of the hollow 14 is received a base indicated generally at 22. A latching member in the form a resilient wire latch piece indicated at 23 with a hook 27 formed on the lower end and with the end opposite hook 27 secured in a recess or notch formed in the subassembly 20 is disposed to have hook 27 engage and disengage a cardiod cam surface 25 on the base 22 upon user movement of switching subassembly 20 with respect to the base 22. A user actuator or pushbutton 24 is received over and attached to the upper end of the switching member subassembly 20. The pushbutton 24 has certain areas of the surface thereof illustrated in dashed outline and denoted by reference numerals 26, 28 formed as lenses or translucent areas which are illuminated as will hereinafter be described.

Figure 1:
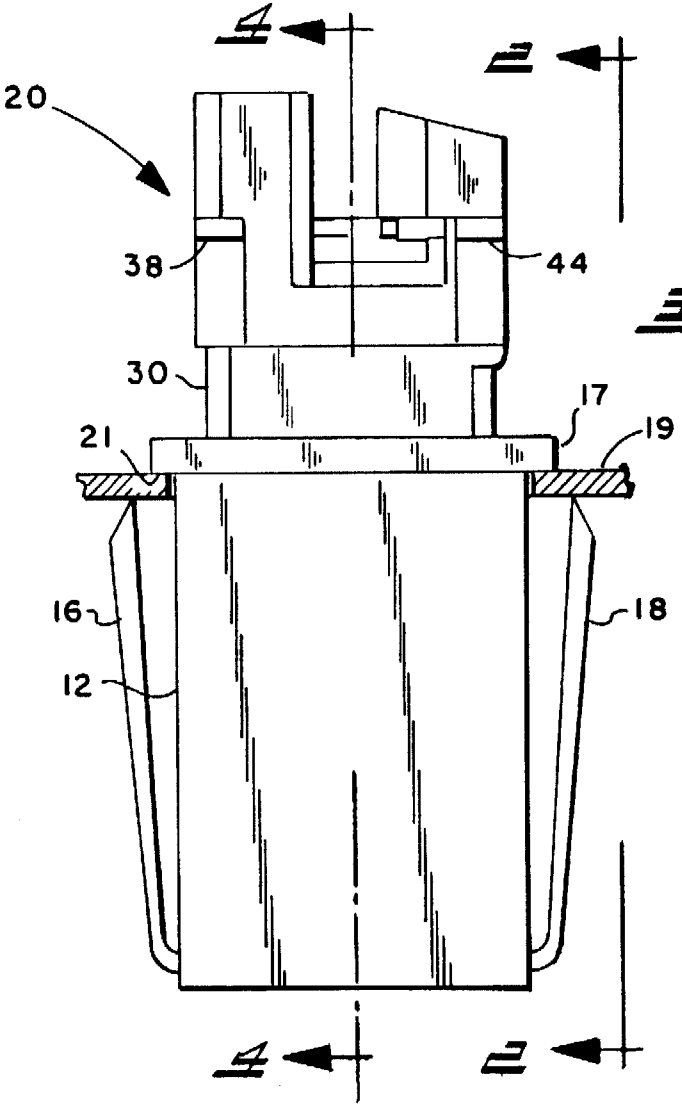
FIG. 1 is a front elevation view of the switch assembly of the present invention without the button.
Figure 3:
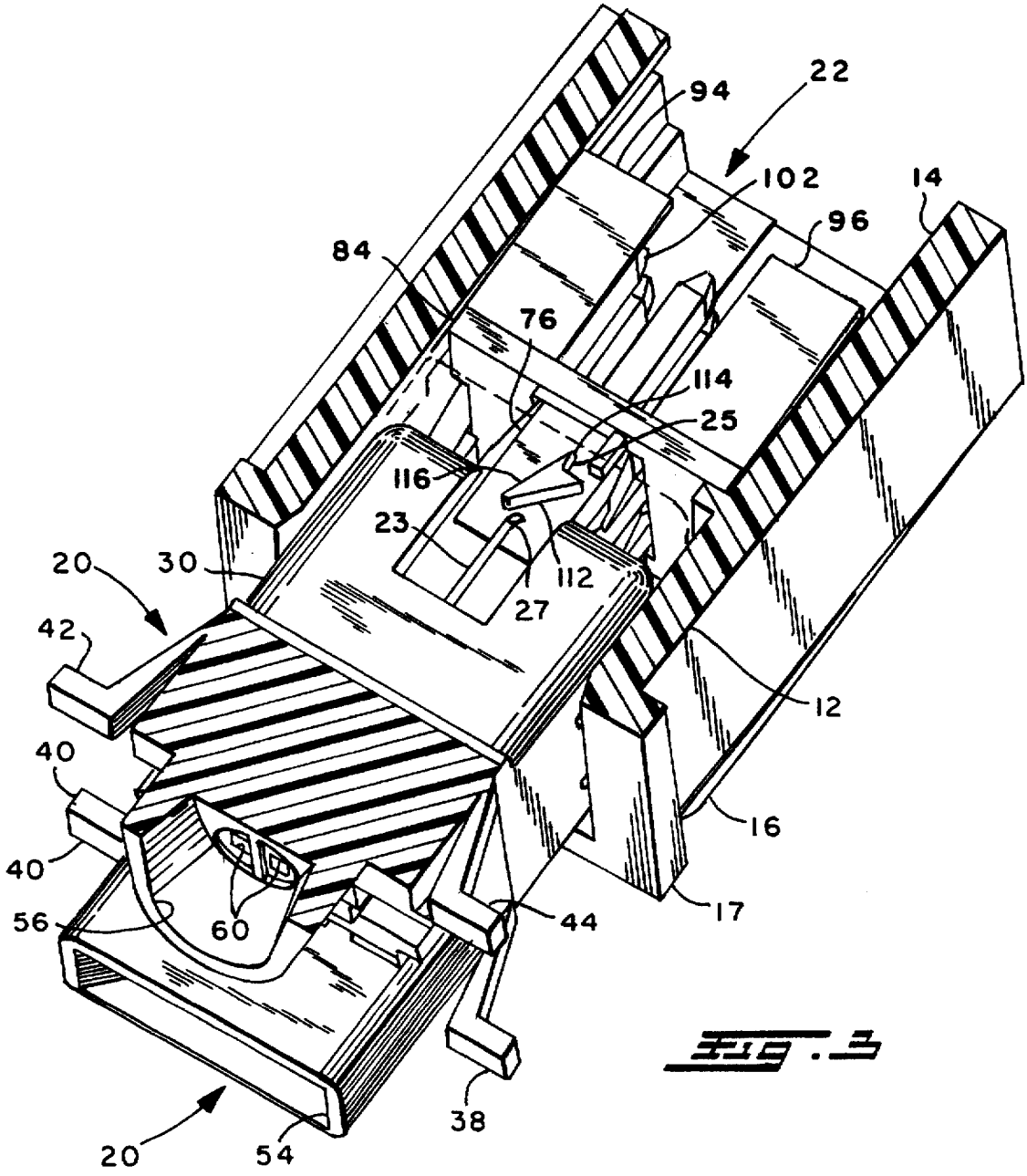
FIG. 3 is an axonometric view of the switch assembly of FIG. 2 with portions of the housing broken away.
Figure 7:
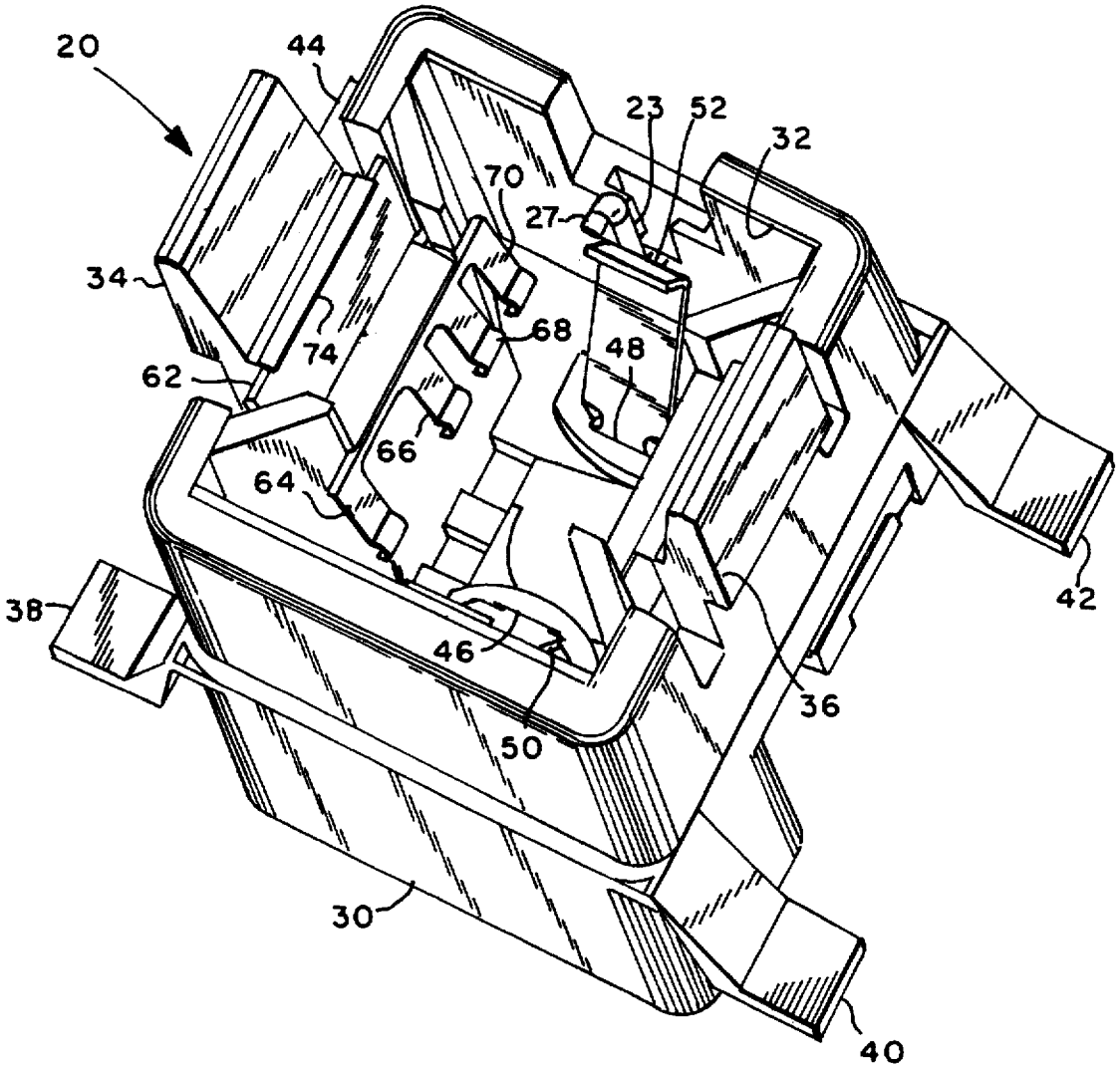
FIG. 7 is an axonometric view of a subassembly of the present invention.
Figure 8:
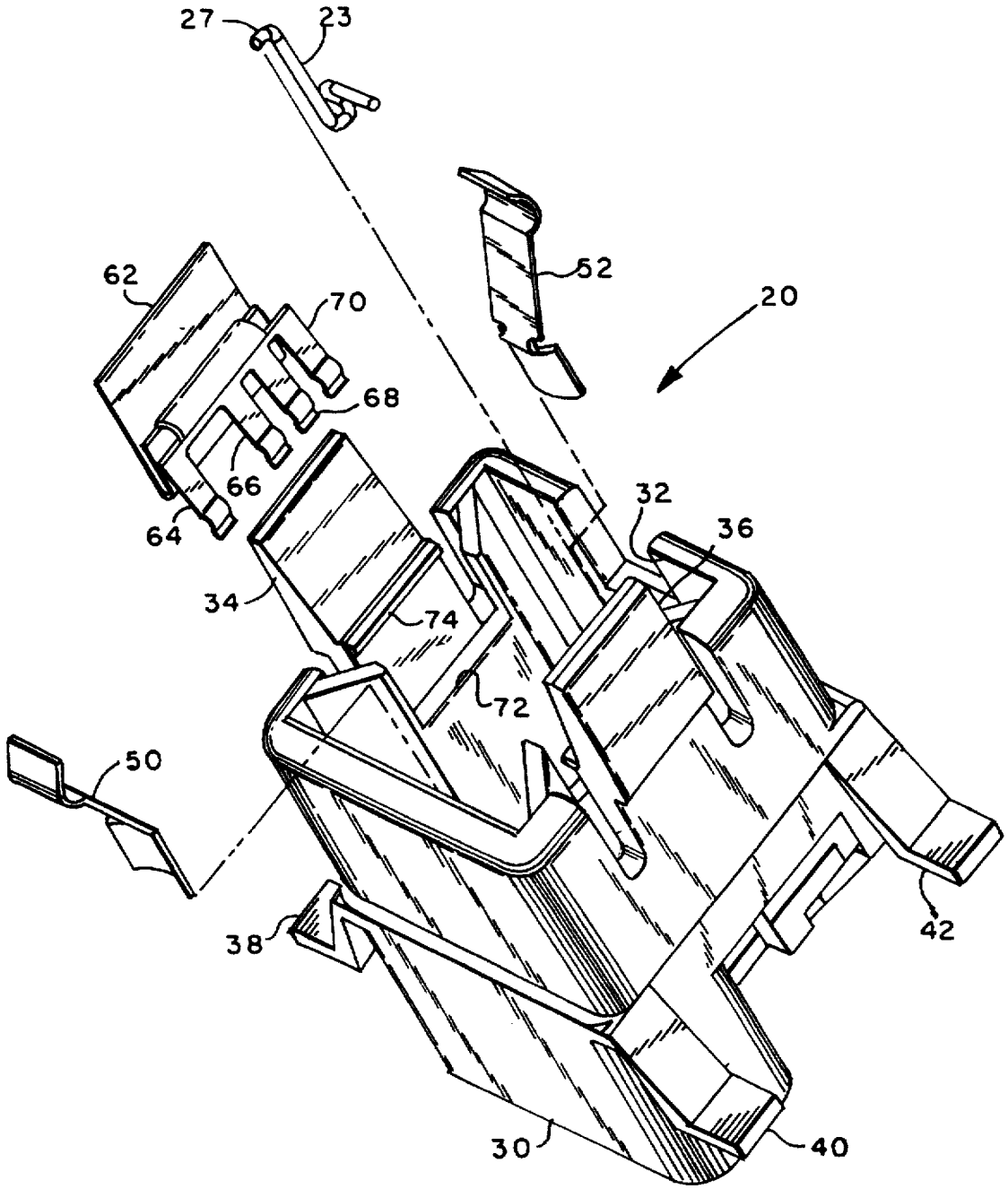
FIG. 8 is an axonometric exploded view of FIG. 7.

Referring to FIGS. 3, 7 and 8, the switching member subassembly 20 is illustrated in greater detail, although inverted from the illustration in FIG. 1, as having a body 30 which has a hollow portion or receptacle 32 formed in one end thereof and which is preferably rectangular in configuration. Body 30 has a pair of snap locking tabs extending therefrom on opposite sides thereof as denoted by reference numerals 34, 36. The switching member body 30 has a plurality of additional spring tabs mounted on the end thereof opposite tabs 34, 36 as denoted by reference numerals 38 through 44; and, these tabs are adapted to engage the undersurface of pushbutton 24 for securing the pushbutton to the body member 30.

Figure 5:
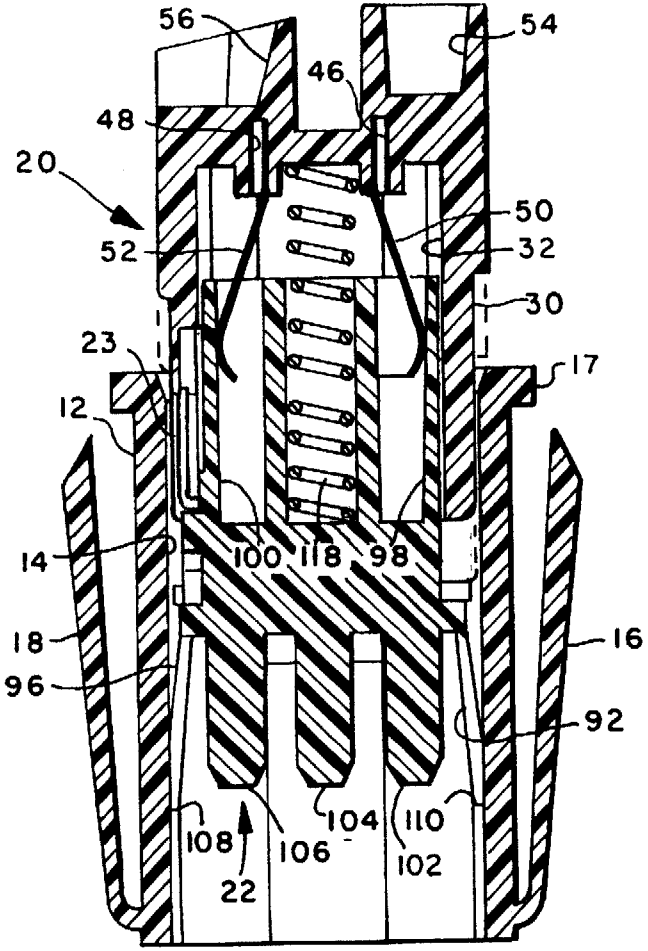
FIG. 5 is a section view taken along section indicating lines 5—5 of FIG. 4.
Figure 6:
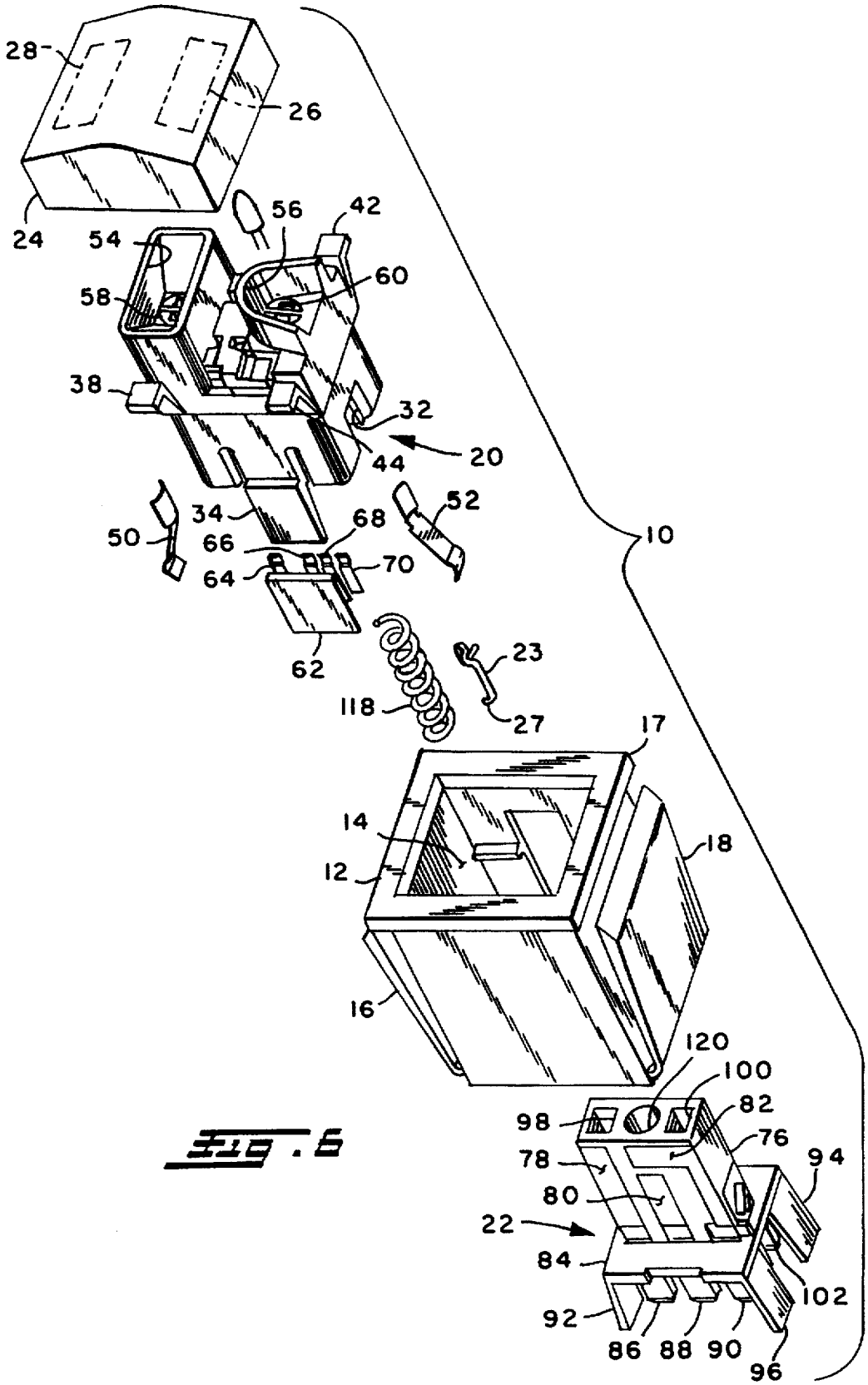
FIG. 6 is a an exploded axonometric view of the switch assembly of the present invention with the button; positioned thereon.

Referring now to FIGS. 5, 6 and 7, the body 30 is molded with plastic strips formed therein by the two-shot molding process which strips have their surface plated with conductive material to form electrical connectors in each of the sockets formed in receptacle 32 denoted by reference numerals 46, 48. Each of the sockets 46, 48 has inserted therein one end of a wiper contact 50, 52 which makes electrical contact with the conductive strip (not shown) in each of the sockets 46, 48.

Referring to FIGS. 3 and 6, the sockets 58, 60 each have the conductive strip therein extending upwardly into one of the lamp receptacles 54, 56 formed in the upper end of the body 30; and, the unshown conductive strips extend into sockets 58, 60 and are adapted to have the leads of a source of illumination (not shown) such as an LED bulb inserted therein.

Figure 4:
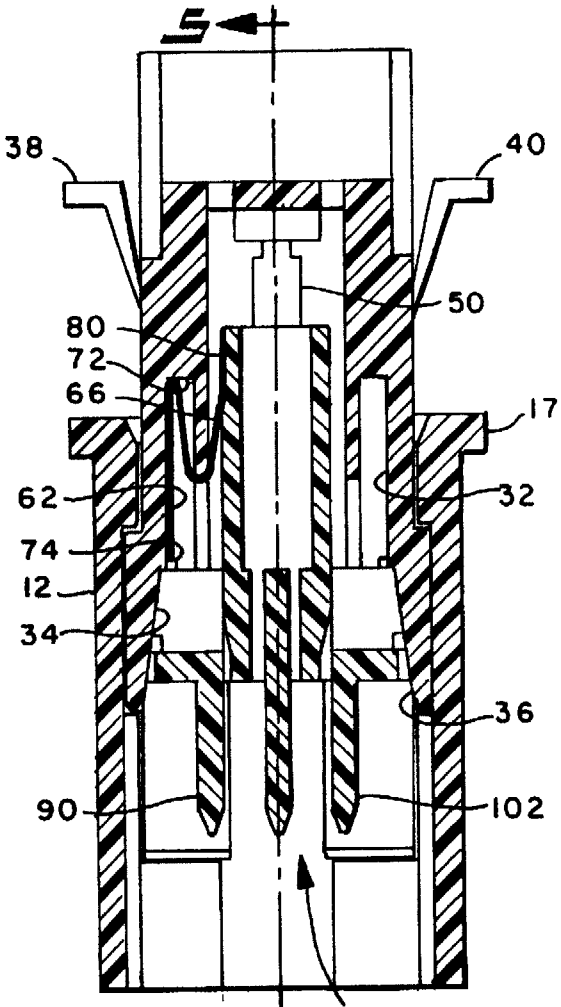
FIG. 4 is a section view taken along section-indicating lines 4—4 in FIG. 1.

Referring to FIGS. 4 and 8, a switching wiper member 62 has a plurality of individual wiper fingers formed thereon and extending therefrom as denoted by reference numerals 64 through 70; and, member 62 has a somewhat serpentine configuration in transverse section with one edge thereof frictionally and movably secured between a ledge 72 in body 30 and a tab or extension 74 provided on the inside surface of locking tab 34. If desired a similar wiper assembly may be attached to the inner side of locking tab 36, but has been omitted in the drawings for illustration of the invention in its simplest form and for clarity of illustration.

Referring to FIGS. 3 and 6, base 22 has an upper portion 76 which has a generally rectangular configuration and is adapted to be inserted in the receptacle 32 of body 30.

The upper portion 76 of the base 22 has a plurality of electrically conductive strips 78, 80, 82 provided on one face thereof and which are formed by electroplating the second shot strips in a two-shot molding process. Each of the strips 78, 80, 82 extends downwardly through an enlarged flange portion 84 of base 22 and extends downwardly therefrom to form the surface one of the terminal pins denoted respectively by reference numeral 86, 88, 90. It will be understood, that similar strips may be molded on the opposite face of the upper portion 76 of base 22; and, similarly such unshown strips may extend downwardly to form additional terminal pins. It will be understood that in the assembled condition, the strips are contacted by one of the wipers 64 through 70 on the wiper member 62 as the switching member 20 is moved slidably within the housing 12; and, the configuration of the strips 78, 80, 82 determines the switching arrangement or logic.

The base 22 is attached to the housing 12 by a plurality of and preferably four spring tabs extending downwardly from the flange portion 84, three of which are illustrated and denoted by reference numerals 92, 94, 96. Referring to FIG. 5, upon insertion of the base into the receptacle 32 of body 30 each of the tabs is snap locked against a correspondingly provided surface such as a notch or ledge 108, 110 formed in the hollow 32 of member 30, thus retaining the base securely in the housing 12.

The base, with the integrally formed terminal pins 86 through 89, 102 through 106 is releasable and readily removable from the housing 12 by compressing tabs 92, 94, 96 with a suitable tool. Thus, by removing only the base and inserting a new base with a different arrangement of strips 78, 80, 82, the logic of the switching function of the assembly 10 may be changed without the need to retool and replace any other parts of the switch assembly. This arrangement enables the switching members subassembly 20 and housing to be used without alteration on multiple switching arrangements, resulting in significant economics of manufacture for a variety of different switching arrangements.

A plurality of spaced recesses denoted by reference numerals 98, 100 are provided in the upper surface of the portion 76 of the base with each of the recesses having on the outboard portion of the inner wall thereof an electrically conductive strip (not shown) formed by the two-shot molding process and subsequent electroplating of the second shot and which is extended downwardly through flange 84 to form a connector pin, one of which is illustrated in FIG. 1 and denoted by reference numeral 102. It will be understood that upon insertion of the switching member 20 into the hollow 14 of housing 12, the wipers 50, 52 engage respectively the conductive strips in recesses 98, 100. The wipers 50, 52 thus provide continuous electrical connection between the terminal pins and the lamp sockets 58, 60.

In operation, the user depresses button 24 and causes the switching member 30 to move downward or deeper into the housing 12 to the position shown in dashed outline in FIGS. 2, 3 and 5 deflecting hooked end 27 of latch wire 23 over cam surface 112 until the hooked end 27 snaps into the detent or notch 25 of the cam surface, whereupon the switching member 30 is latched in the depressed condition shown in dashed outline. A subsequent downward or depression movement of the switching member 30 by user pressure on button 24 causes the hooked end 27 of latch wire 23 to snap over the apex portion 114 of the cam surface and unlatch, permitting the hooked end of the latch 23 to slide along portion 116 of the cam surface, thereby permitting the switching member to return to its initial or extended position as shown in solid outline FIGS. 2 through 5. It will be understood that a return spring 118 is provided in the base bore 120 and is operative to bias the subassembly 20 outward.

The present invention thus provides a unique and novel push-push button switch assembly having an illuminated pushbutton and an illuminated indicia of the state of switch actuation and which is low in manufacturing cost and assembled easily with a minimum of parts.

Although the present invention has been described hereinabove with respect to the illustrated embodiments, it will be understood that the invention is capable of modification and variation and is limited only by the scope of the following claims.

We claim:

1. A pushbutton switch assembly for mounting on a panel comprising:

(a) a housing formed of dielectric material having a hollow therethrough and integrally formed resilient portions adapted for mounting and retaining on a panel structure;

(b) a switching member formed of dielectric material having a first portion having thereon at least one light source and a second portion distal said first portion defining a receptacle therein, said switching member including a plurality of electrically conductive wipers thereon, said switching member retained in one end of said hollow for sliding movement;

(c) a base member releasably attached to said housing formed of dielectric material two-shot molded to form strips and having conductive material plated on the surface of said strips with said strips disposed on a first portion thereof, said first portion extending into said receptacle of said switching member, said strips each extending integrally to a second portion thereof distal said first portion, said strips each defining in said second portion a terminal adapted for external electrical connection thereto; and, (d) user actuator member attached to said first portion of said switching member including means defining a lens covering said at least one source of light, said actuator means adapted to be contacted by the user for effecting said sliding movement of said switching member with respect to said base, wherein said wipers are operative upon said sliding movement to contact said conductive strips and effect an electrical switching function.

2. The switch assembly defined in claim 1, wherein said base includes a recess in said first portion having one of said plurality of plated conductive strips formed therein with one of said wipers engaging said recess and contacting said plated strip therein.

3. The switch assembly defined in claim 1, further comprising a latching means operative to provide a push-to-engage, push-to-disengage action to said sliding movement of said switching member.

4. The switch assembly defined in claim 1, wherein one of said conductive strips on said base member is connected to said source of illumination.

5. The switch assembly defined in claim 1, wherein said base member is formed of a molded thermoplastic material comprising a first shot of non-palatable material and a second shot of palatable material plated to form said conductive strips.

6. The switch assembly defined in claim 1, wherein said base member is releasably attached to said housing; and, said wiper means includes a wiper member releasably attached to said switching member, wherein the switching function of said assembly may be changed by removal and replacement of only said base.

7. The switch assembly defined in claim 1, wherein said switching member includes a plurality of electrical strips plated thereon and second wiper means on said switching member interconnecting one of said plated strips on said switching member with one of said plated strips on said base; and said light source comprises a light emitting diode (LED) connected to said plurality of plated strips on said switching member.

8. The switch assembly defined in claim 1, wherein said base member has at least one of said strips disposed in a recess and one of said wipers contacting said one of said strips in said recess and another of said wipers contacting another of said strips disposed on the exterior of said first portion of said base member.

9. The switch assembly defined in claim 1, wherein said certain ones of said plurality of wipers are mounted on a holder member releasably attached to said switching member.

10. The switch assembly defined in claim 1, wherein said user actuator is snap-locked onto said switching member.

11. The switch assembly defined in claim 1, wherein said resilient portions of said housing includes a pair of spring tabs disposed on opposite sides of said housing.

12. The switch assembly defined in claim 1, wherein said hollow through said housing has a rectangular configuration.

13. A method of making a pushbutton switch assembly for mounting on a panel comprising:

(a) forming a housing of dielectric material with a hollow therethrough and integrally formed panel mounting portions thereon;

(b) forming a switching member of dielectric material having a receptacle on a first portion thereof and disposing a light source on a second portion thereof and disposing a plurality of conductive wipers thereon and slidably disposing said switching member second portion in said housing hollow;

(c) two-shot molding a base member of dielectric material and forming a plurality strips thereon and plating said strips with conductive material and extending said strips and forming a terminal for connection thereto and inserting said strips into said switching member receptacle;

(d) covering said light source with a lens; and (e) moving said wipers on said conductive material of said strips and effecting a switching function thereon.

* * * * *